US005430985A

United States Patent [19]

Coleman

[11] Patent Number: 5,430,985

[45] Date of Patent: Jul. 11, 1995

[54] BUILDING BLOCK WALL CONNECTOR STRIP AND METHOD OF ASSEMBLING A BLOCK WALL UTILIZING SUCH STRIP

[76] Inventor: William J. Coleman, 28 Henches Pl., Little Ferry, N.J. 07643

[21] Appl. No.: 582,494

[22] Filed: Sep. 14, 1990

[51] Int. Cl.[6] ..... E04B 1/12; E04B 21/14

[52] U.S. Cl. ..... 52/308; 52/656.9

[58] Field of Search ..... 52/306, 307, 308, 656, 52/582, 586, 747, 656.1, 656.9

[56] References Cited

U.S. PATENT DOCUMENTS

| | | | |
|---|---|---|---|
| 3,234,699 | 2/1966 | Smith | 52/308 |
| 3,429,602 | 2/1969 | Dirilgen | 52/656 |
| 3,925,950 | 12/1975 | von der Ley | 52/307 |
| 4,095,384 | 6/1978 | Zarrielo . | |
| 4,891,925 | 1/1990 | Carlson et al. | 52/306 |
| 4,986,048 | 1/1991 | McMarlin | 52/306 |
| 5,010,704 | 4/1991 | Thompson | 52/308 |
| 5,031,372 | 7/1991 | McCluer | 52/308 |

*Primary Examiner*—Michael Safavi

[57] ABSTRACT

A connector strip is disclosed for assembling a building wall of glass blocks. The strip includes a longitudinal center section having a pair of oppositely disposed and longitudinally extending grooves dimensioned to receive a centrally located ridge extending peripherally around the outer edge surfaces of a molded building block to which the strip is to be mounted. A flange projects laterally outwardly from each longitudinal edge of the center section. The flanges have outwardly profecting walls and a plurality of laterally extending ribs which project outwardly from the walls. The flanges, walls and ribs define a plurality of open compartments on opposite sides of the flanges. Resiliently compressible material is mounted to the center section which engages with the outer edge surface of the building block to which the strip is to be mounted. A fastener member also is provided for coupling together adjacently positioned connector strips to form a rigid framework for assembling successive rows of blocks into a wall assembly.

9 Claims, 4 Drawing Sheets

BUILDING BLOCK WALL CONNECTOR STRIP AND METHOD OF ASSEMBLING A BLOCK WALL UTILIZING SUCH STRIP

BACKGROUND OF THE INVENTION

I. Field of the Invention

This invention relates to a connector strip for assembling a building block wall assembly, and to the method of assembling the block wall utilizing such strip.

II. Description of the Prior Art

Heretofore, it is known to assemble a building block wall assembly utilizing a spacer strip positioned between the edge surfaces of adjacently positioned blocks and between the opposite or flat faces of successive rows of such blocks to form the wall. An example of such a spacer fabricating device is disclosed in U.S. Pat. No. 4,095,384 dated Jun. 20, 1978 issued to Daniel A. Zarrielo. The fabricating device of this patent is an elongated corrugated cardboard strip having upper and lower surfaces thereof coated with a tar composition. The strips are positioned between tiers of building blocks and between the edge surfaces of adjoining blocks. The strips are mounted to the respective blocks by means of engagement of the tar surfaces of the strips to the adjacent surfaces of the blocks. Specifically, by pressing the blocks into the tar composition on the surfaces of the associated strips, it is possible to align the adjacently positioned blocks and the successive rows or tiers of such blocks to form a wall assembly.

The strips have a width less than the width of the building blocks to which said strips are respectively mounted to form a groove or channel between the outer edges of adjacently located blocks. A mortar composition is then filled within such grooves to anchor the blocks and connector strips in place.

While the fabricating device of the '384 patent satisfactorily performs its intended function for building a wall of cinder blocks, there arises a need to improve upon such fabricating device when assembling a wall of glass blocks. Glass blocks are molded in various sizes and shapes and are of styles such as available from Pittsburgh Corning Corporation, Pittsburgh, Pa. 15239, U.S.A. Typical of such styles is a 6 inch (15.24 cm) square block having a thickness of 3.875 inches (9.84 cm). As part of the molding process, the blocks are formed each having a centrally located ridge extending peripherally around the outer edge surfaces thereof.

Utilizing the fabricating device of the '384 patent to glass blocks of the kind described above does not prove entirely satisfactorily in view of the ridge formed on the edge surfaces of the block. That is, the relatively flat surfaces of the corrugated cardboard strip do not lend themselves to providing a secure mounting arrangement to the outer edge surfaces of the glass blocks. This, in turn, prevents an accurate alignment of the successive rows or tiers of blocks.

The inventor named herein experimented with modifying the corrugated cardboard strip of the '384 patent to include a groove in the flat surfaces to accommodate the glass block ridge. While such modified corrugated cardboard strips eliminated some of the problems associated with using such strips in a glass block wall assembly, the strips still were not found to be that effective for anchoring the blocks in place. This was primarily due to the flexibility of the strips and to the inability of connecting the strips together to form a framework for the blocks.

It has become apparent that a different type of connector strip is needed for assembling a block wall structure utilizing glass blocks. The present invention improves on the applicant's earlier modifications to the corrugated cardboard strip of the '384 patent by providing a rigid connector strip which is formed with grooves to accommodate the glass block ridge. A fastener element also is provided to couple together adjacent segments of adjacently positioned connector strips to form a substantially rigid framework for each block which enables rows or tiers of such glass blocks to be easily and accurately aligned in place, and be firmly anchored to one another. A summary of the features applicable to the improved and novel connector strip is hereinafter set forth.

SUMMARY OF THE INVENTION

The present invention provides for a rigid longitudinal connector strip formed having a longitudinally extending center section. The center section has oppositely disposed outer flat surfaces each of which is formed having a longitudinally extending groove centrally located thereon. The grooves are dimensioned to receive therein a portion of the centrally located ridge extending peripherally around the outer edge surfaces of the molded glass building block to which said strip is to be mounted.

A longitudinally extending flange projects laterally outwardly from each of the longitudinal edges of the center section. The flanges are centrally located along the thickness of the center section and extend for the length of the strip. Also, the thickness of the flanges is less than the thickness of the center section. The flanges terminate in longitudinally extending edges of the strip.

As was the case with the fabricating device of the '384 patent, the width of the instant strip is less than the width of the building block to which the strip is to be mounted to locate the longitudinal edges of the flanges in contact with marginal edge surfaces of the building block.

Each of the flanges has a pair of oppositely disposed and longitudinally extending walls projecting outwardly from opposite surfaces thereof. The walls are centrally located along the width of the flanges, with the walls of each pair being aligned in the same plane and extending for the length of the strip.

Each of the flanges also may have a plurality of oppositely disposed and laterally extending ribs projecting outwardly from the walls on opposite sides of the flanges. The construction is such that the flanges having a configuration to permit at least some of the ribs to engage marginal edge surfaces of the building block to which the strip is to be mounted. The oppositely disposed and laterally extending ribs are arranged in pairs aligned in the same plane, with said ribs projecting outwardly of the respective walls to the longitudinal edges of the strip.

Resiliently compressible material also may be mounted to the opposing surfaces of the center section on either side of the longitudinally extending grooves. The compressible material serves to compensate for irregularities in the outer edge surfaces of the block to which said strip is to be mounted on either side of the building block ridge. The compressible material has an outer surface coated with a pressure sensitive adhesive, and is provided with a removable release sheet adapted to be removed from the adhesively coated surface when the strip is mounted to the block.

The overall arrangement described above provides for the longitudinal flanges, the longitudinal walls, and the lateral ribs to define a plurality of open compartments on opposite sides of the flanges which compartments extend along the longitudinal edges of the strip.

The invention further provides for a fastener to couple together adjacent segments of adjacently positioned connector strips to from a substantially rigid framework to erect a wall of such glass blocks. The fastener also is of substantially rigid material and is formed having first and second post elements spaced apart from one another by an interconnecting web. The posts are sized to be frictionally received in the spaces, respectively, between the longitudinal edges of the center section of the connector strips and the longitudinal walls on the flanges of the strips. The web serves to space the posts apart from one another by a distance substantially equal to the lateral distance between the longitudinal edges of the center section of the strips.

Each of the post elements has a pair of oppositely disposed and aligned slit openings sized to engage with the flanges of the connector strips for coupling together the lateral edges of adjacent segments of the strips. In this coupling arrangement, it is necessary for the web segment of the fastener to have a pair of oppositely disposed and aligned cut-out notches which are located to be in alignment with the longitudinal grooves, respectively, of the connector strips when the strips are coupled together.

In another coupling arrangement, the posts may be regarded as having first and second oppositely disposed stem portions projecting from opposite surfaces, respectively, of the interconnecting web and projecting substantially perpendicular to the plane of the web. The first stem portion of each post has the slit opening previously referred to which is sized to engage with the lateral edges of the flanges, respectively, of one of the connector strips. The second stem portion of each post is sized to be received in the spaces, respectively, between the longitudinal edges of the center section of the other one of the adjacent connector strips and the longitudinal walls on the flanges of said other connector strip for coupling together the connector strips in a substantially perpendicular configuration.

The connector strips and the associated fasteners permit the user to assemble successive rows of blocks in which each block is set-off from the next adjacent block by a framework of such connector strips. That is, interengaging or interlocking connector strips are mounted to all four edge surfaces of each block during the assembly operation. After the wall is assembled, the spacing between the outer edges, respectively, of adjacently located blocks and the adjacent longitudinally extending walls of the associated strips defines a plurality of channels which include the open compartments formed by the laterally projecting ribs. A binder composition is then applied within the channels to anchor the blocks and the associated connector strips in place.

There is, thus, provided a novel connector strip for assembling a building wall of glass blocks which is relatively simple in nature, and which can be used by a person with little or no special training in the art of assembling building block wall assemblies.

Additional features and advantages of the present invention will become more apparent from a consideration of the following detailed description when taken in conjunction with the accompanying drawings.

DESCRIPTION OF THE PREFERRED EMBODIMENT

Figure 1:
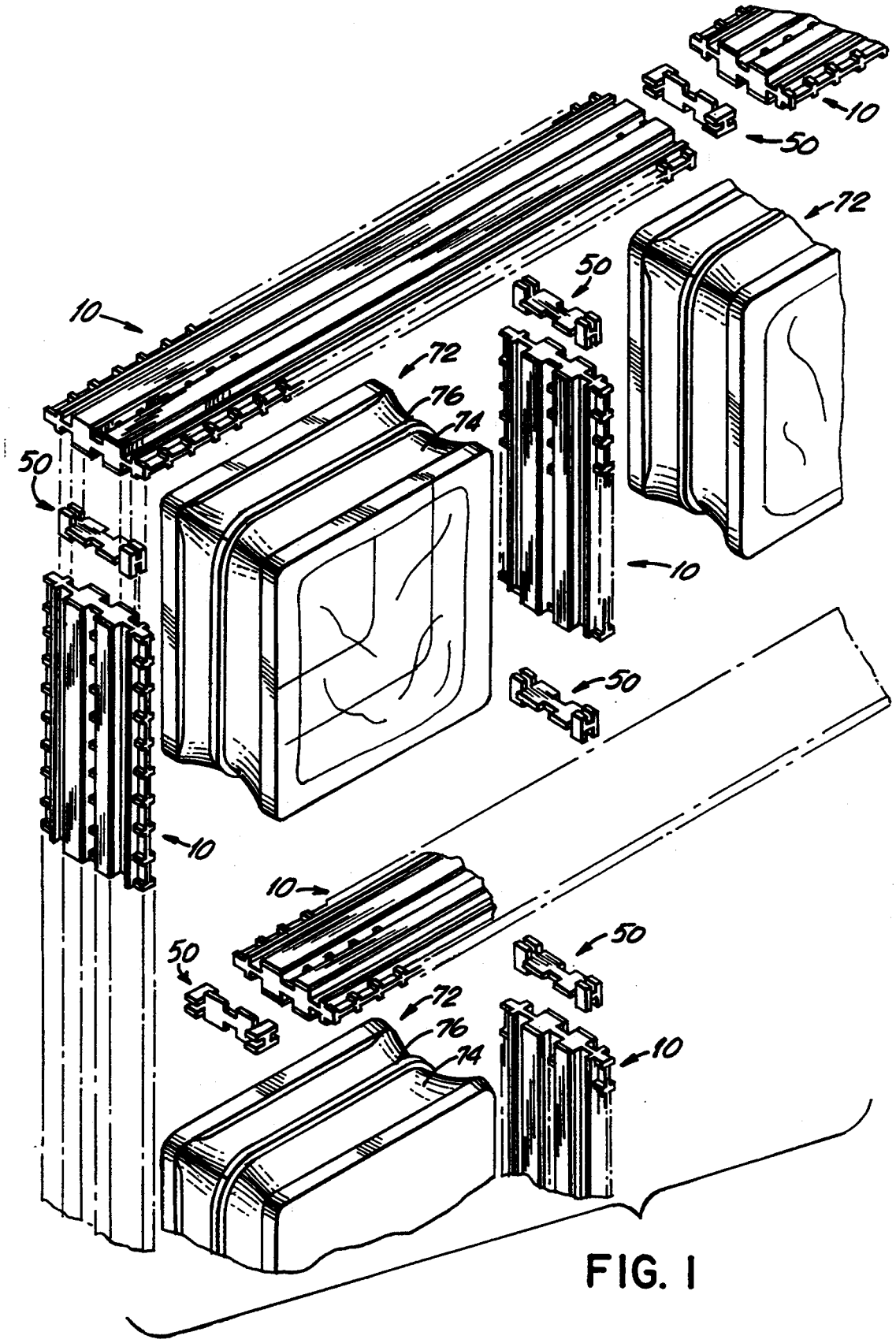
FIG. 1 is a partial exploded perspective view of a glass block wall assembly utilizing the connector strips of the present invention.
Figure 3:
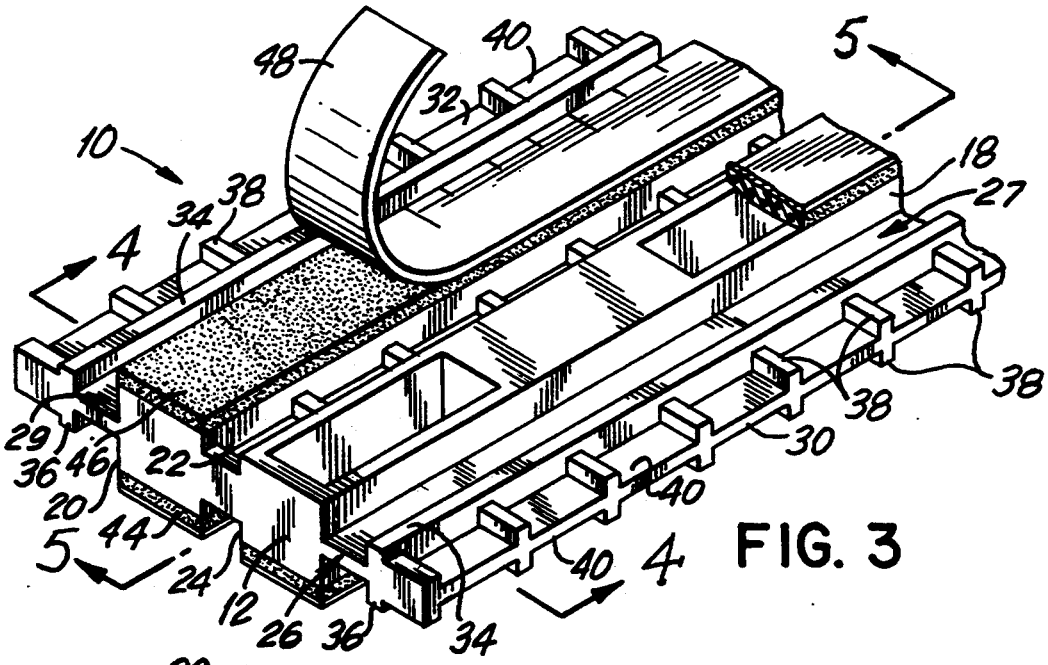
FIG. 3 is a partial perspective view of the connector strip constructed in accordance with the present invention.
Figure 4:
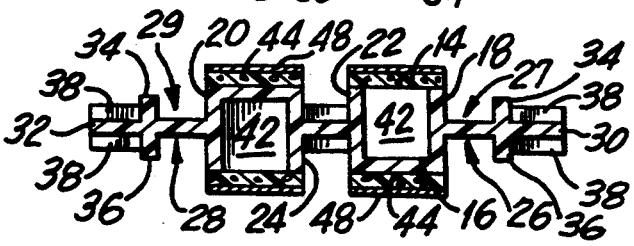
FIG. 4 is a sectional view taken along line 4—4 of FIG. 3.
Figure 5:
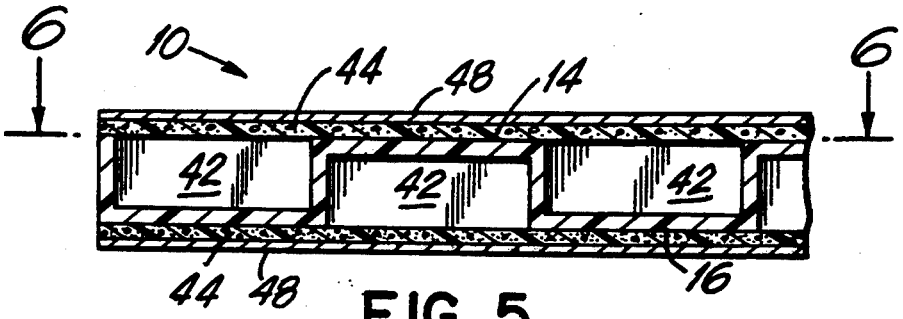
FIG. 5 is a sectional view taken along line 5—5 of FIG. 3.
Figure 6:
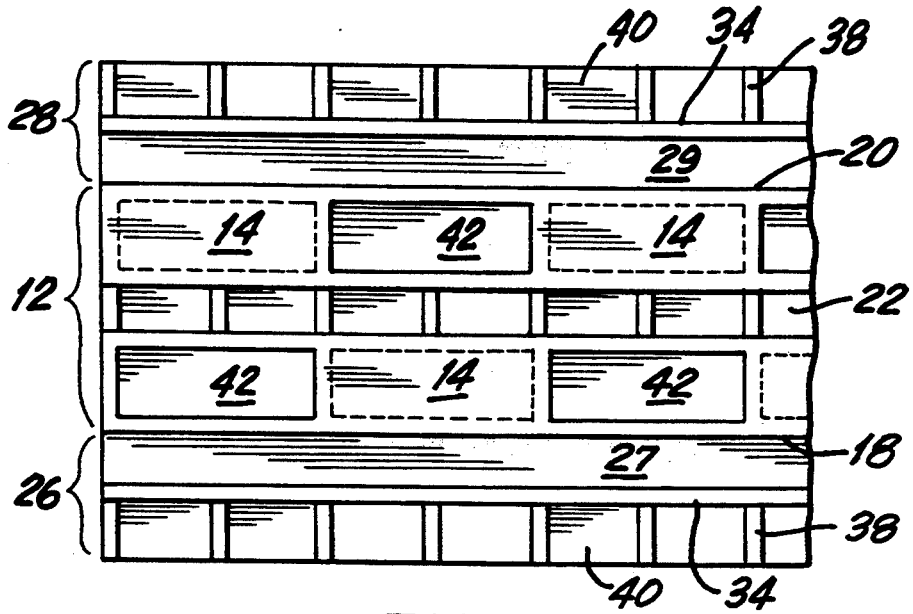
FIG. 6 is a sectional view taken along line 6—6 of FIG. 5.
Figure 7:
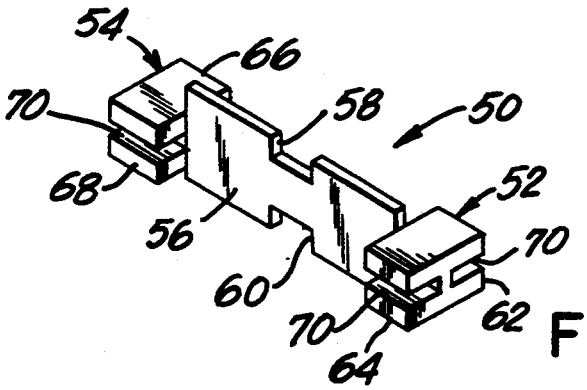
FIG. 7 is a perspective view of the fastener member used to couple together adjacent segments of the connector strips.
Figure 8:
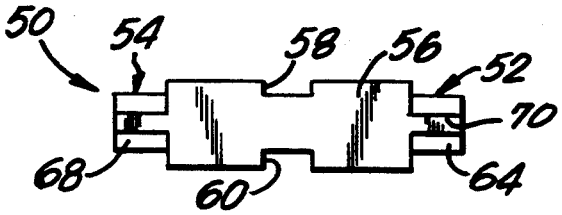
FIG. 8 is a front elevational view of the fastener member of FIG. 7.
Figure 9:
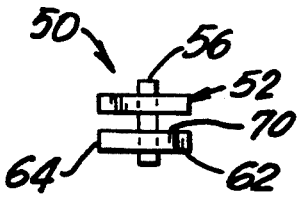
FIG. 9 is an end or side elevational view of the fastener member of FIG. 8.
Figure 10:
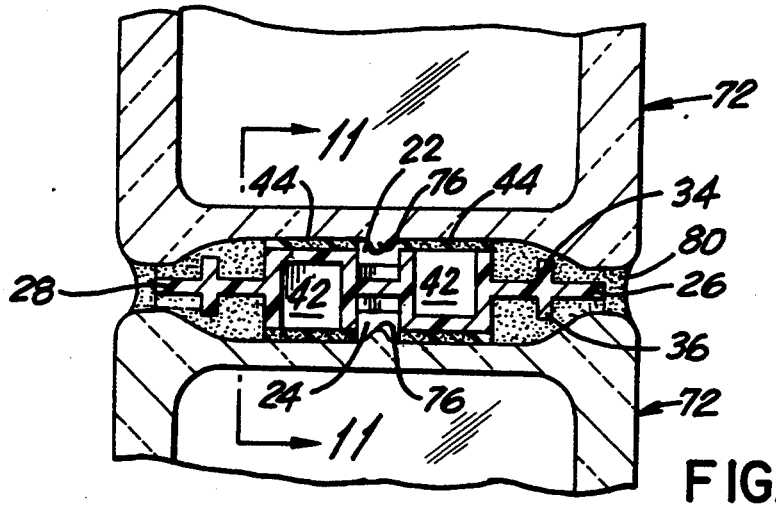
FIG. 10 is a sectional view taken along line 10—10 of FIG. 2.
Figure 11:
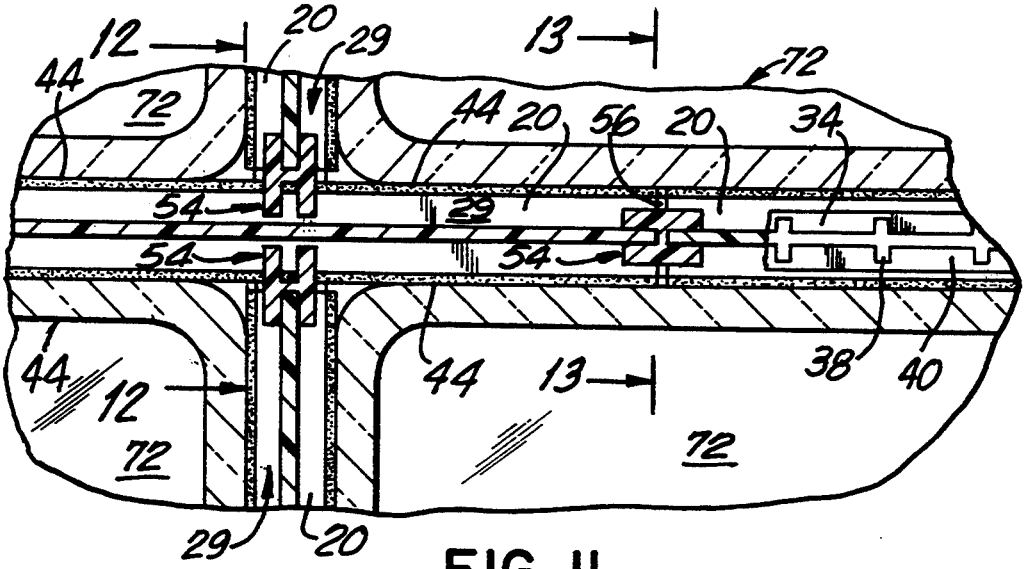
FIG. 11 is a sectional view taken along line 11—11 of FIG. 10.
Figure 12:
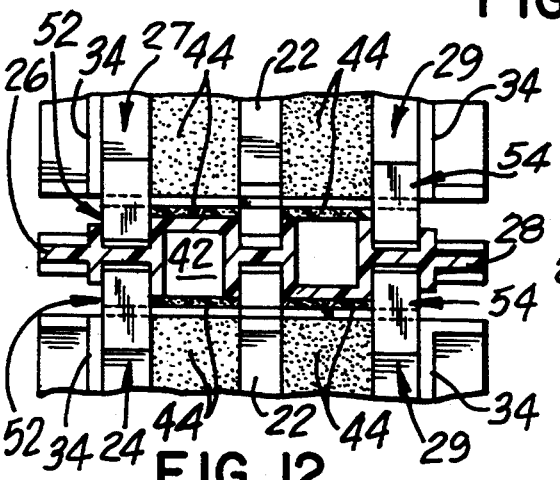
FIG. 12 is a sectional view taken along line 12—12 of FIG. 11.
Figure 13:
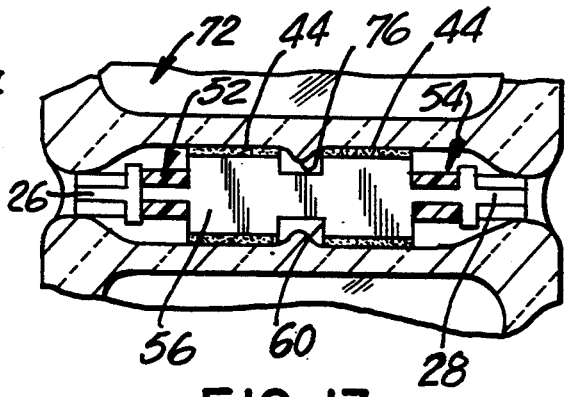
FIG. 13 is a sectional view taken along line 13—13 of FIG. 11.

Referring to the drawings, particularly FIGS. 1 and 3, numeral 10 represents a longitudinal connector strip constructed in accordance with the present invention. Except as noted hereinafter, strip 10 is substantially rigid and is molded of polyethylene or polypropylene material.

Strip 10 is formed having a longitudinally extending center section 12 having a first outer surface 14 and a second oppositely disposed outer surface 16 spaced apart from one another by a predetermined thickness. Center section 12 terminates in first and second longitudinally extending edges 18 and 20, respectively.

A longitudinally extending groove 22 is formed in surface 14 and a similar groove 24 is formed in surface 16. Grooves 22 and 24 are centrally located on said respective surfaces and have dimensions to receive therein a portion of a centrally located ridge extending peripherally around the outer edge surfaces of a molded building block to which strip 10 is to be mounted as hereinafter described.

Projecting laterally outwardly from the longitudinal edges 18 and 20 of center section 12 are first and second longitudinally extending flanges represented generally by numerals 26 and 28, respectively. Flanges 26 and 28 are centrally located along the thickness of center section 12 and extend for the length of strip 10. Flanges 26 and 28 each have a thickness less than the thickness of center section 12, and terminate in first and second longitudinally extending edges 30 and 32, respectively, of strip 10.

As will become hereinafter apparent, the width of strip 10 is less than the width of the building block to which said strip to be mounted to locate the longitudinal edges 30 and 32 of flanges 26 and 28, respectively, in contact with marginal edge surfaces of the building block.

Flanges 26 and 28 each have a pair of oppositely disposed and longitudinally extending walls 34 and 36 projecting outwardly from opposite surfaces, respectively, thereof. Walls 34 and 36 are centrally located along the width of the respective flanges 26 and 28. The walls 34 and 36 of each pair are aligned in the same plane and extend for the length of connector strip 10. The spaces between the longitudinal edge 18 of center section 12 and the adjacent flange walls 34 and 36 are represented by numeral 27 whereas the spaces between the longitudinal edge 20 of center section 12 and the adjacent flange walls 34 and 36 are represented by numeral 29.

It is preferred that flanges 26 and 28 also be formed each having a plurality of oppositely disposed and laterally extending ribs 38 projecting outwardly from walls 34 and 36 on opposite sides of said flanges. The configuration of flanges 26 and 28 is such as to permit at least some of ribs 38 to engage marginal edge surfaces of the building block to which strip 10 is to be mounted as hereinafter described. The oppositely disposed and laterally extending ribs 38 are arranged in pairs aligned in the same plane, with the plurality of pairs of such ribs spaced apart from one another over the length of strip 10. Ribs 38 project outwardly of walls 34 and 36 to the longitudinal edges 30 and 32, respectively, of strip 10. In the configuration thus described, the longitudinal flanges 26 and 28, each with their associated longitudinal walls 34 and 36 and lateral ribs 38, define a plurality of open compartments 40 on either side of flanges 26 and 28 extending along the longitudinal edges 30 and 32, respectively, of strip 10.

The surfaces 14 and 16 of center section 12 are formed having a plurality of spaced-apart openings 42 extending longitudinally the length of strip 10. Openings 42 are substantially rectangular in configuration and alternate in their placement along surfaces 14 and 16. That is, the openings 42 are sequentially placed along said surfaces such that an opening on surface 14 is followed by an opening on surface 16 and the pattern thus repeated alternating between such surfaces. Openings 42 are provided to reduce the weight of strip 10 and to facilitate the molding procedure of such strip.

Mounted to surfaces 14 and 16 of center section 12 is a resiliently compressible material 44 made of foam or rubber or the like. Compressible material 44 extends for the length of strip 10 and is positioned in overlying relation to the openings 42. The outer surface of material 44 is coated with a pressure sensitive adhesive 46. A release sheet 48 is mounted to the adhesive surface 46 and is adapted to be removed therefrom when strip 10 is mounted to the building block. The compressible material 44 is used to take into account irregularities in the outer edge surfaces of the block as hereinafter described.

Referring to FIGS. 1 and 7–9, there is shown a fastener member represented generally by the numeral 50 for coupling together adjacent segments of adjacently positioned connector strips 10. Fastener 50 is made of substantially rigid plastic, as is strip 10, and is formed having a first post element 52 and a second post element 54 spaced apart from one another by an interconnecting web 56. The web 56 serves to space apart posts 52 and 54 by a distance substantially equal to the lateral distance between the longitudinal edges 18 and 20 of strip center section 12.

Web 56 also is formed having a pair of oppositely disposed and aligned cut-out notches 58 and 60. As will become hereinafter apparent, notches 58 and 60 are located to be in alignment with the longitudinal grooves 22 and 24, respectively, of strip center section 12 when adjacent strips 10 are coupled together.

Post 52 may be regarded as defining a pair of oppositely disposed stem portions 62 and 64 projecting from opposite surfaces, respectively, of web 56. Post 54 similarly defines a pair of oppositely disposed stem portions 66 and 68 which also project from opposite surfaces, respectively, of web 56. The configuration is such that stem portions 62, 64, 66 and 68 project in a direction substantially perpendicular to the plane of web 56.

Each of the stem portions 62, 64, 66 and 68 is formed having a slit opening 70 whereby the slits 70 in post 52 and the slits 70 in post 54 are sized to frictionally engage with the lateral edges of the flanges 26 and 28, respectively, of adjacently positioned connector strips 10 for coupling together the lateral edges of adjacent segments of said strips as hereinafter noted. In yet another coupling arrangement, corresponding stem portions of fastener posts 52 and 54, such as stem portions 62 and 66, may be employed to engage with the lateral flange edges of one strip while corresponding stem portions 64 and 68 are sized to be frictionally received in the spaces 27 and 29, respectively, between the longitudinal edges 18 and 20 of the center section 12 of an adjacent strip 10 and the flange walls 34 and/or 36 of said adjacent strip for coupling together the connector strips 10 in a substantially perpendicular configuration.

Referring to FIG. 1, the glass block is represented by numeral 72 having outer edge surfaces 74. A centrally located ridge 76 extends peripherally around the outer edge surfaces of the block. If strips 10 are regarded as being disposed in horizontal and vertical positions, the elongated horizontal strips 10 may be formed in 3 foot (91.44 cm) lengths so as to span or cover a plurality of adjacently positioned blocks 72. Where necessary, a plurality of such horizontally disposed strips 10 may be coupled together in edge-to-edge relation by fastener member 50. In such event, the slit openings 70 engage the lateral edges of the respective flanges of the adjacently positioned strips whereby notches 58 and 60 of fastener 50 are located in alignment with the grooves 22 and 24, respectively, of said strips.

The invention further provides for a vertically orientated connector strip 10 to be disposed between adjacent blocks 72. These so-called vertical strips are of a length slightly less than the height of the block. Here, again, the same kind of fastener member 50 is used to couple a vertically oriented strip to a horizontally oriented strip. In this arrangement, corresponding stem portions on one side of fastener 50 engage the lateral flange edges of the vertical strip while the opposite corresponding stem portions are received in the spaces of the horizontal strip formed between the longitudinal edges of the center section and the flange walls. The end result is to form a substantially rigid framework around each block with the horizontally and vertically oriented connector strips coupled together by the fastener members.

When mounting the connector strips 10 to the respective blocks 72, it will be appreciated that the release sheet 48 is first removed from the adhesive surface 46 of the compressible material 44. The strip is then positioned on the edge surface 74 of block 72 with the block ridge 76 received in the central groove 22 or 24, as the case may be, of strip center section 12. This serves to locate the compressible material 44, which is positioned on either side of the groove, in engagement with the outer edge surfaces of the block on either side of the block ridge. The strip is firmly mounted to the block without undue play by reason of the compressible material 44 which takes into account any irregularities or unevenness in the edge surfaces of the block.

Figure 2:
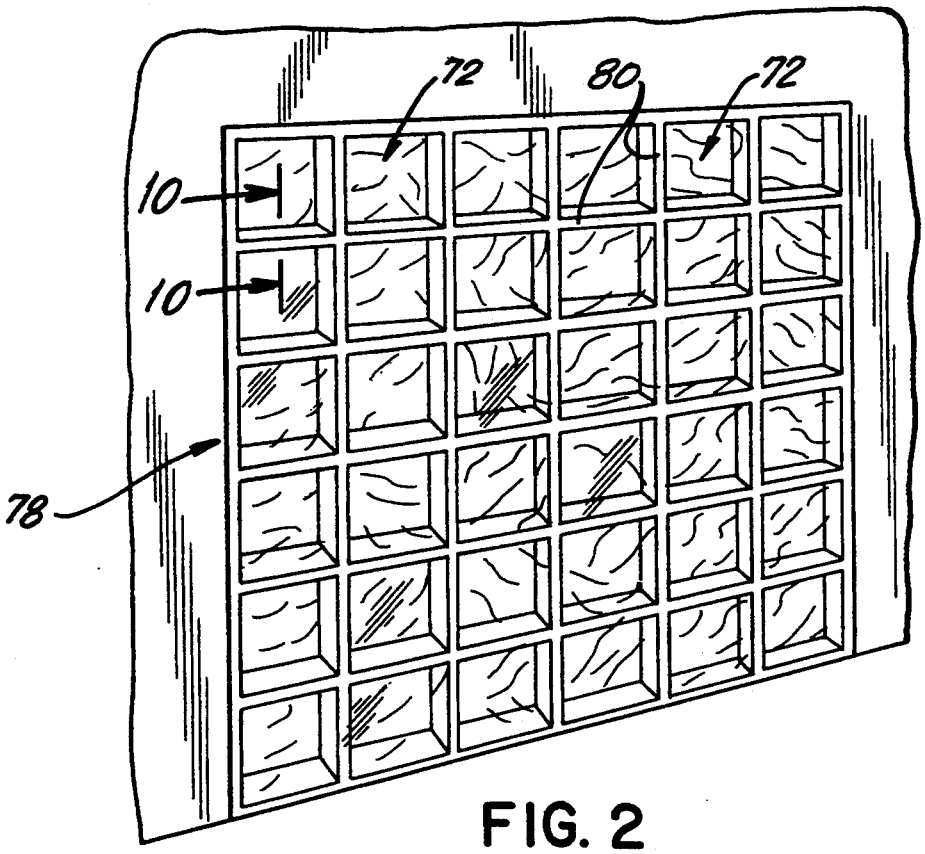
FIG. 2 is a perspective view of the block wall assembled from the components illustrated in FIG. 1.

FIG. 2 illustrates a building wall represented generally by numeral 78 assembled from the components of FIG. 1. In assembling building wall 78 it may be assumed that an opening has been formed in the structure which is to contain the rows or tiers of glass blocks 72. The size of the opening can be predetermined from the dimensions of the blocks. Also, once the height of the block is known, the so-called vertical strips that make-up the framework between adjacent blocks can be cut to be of a length slightly less than the block height. The width of the strip is selected to be less than the width of the block thereby to locate the flange ribs in contact with marginal edge surfaces of the block. The arrangement is such that the longitudinal flanges, the longitudinal walls and the lateral ribs define a plurality of open compartments on opposite sides of the flanges extending along the longitudinal edges of the strip.

For example, where the width of the block is 3.125 inches (7.94 cm), the width of the strip may be 2.624 inches (6.67 cm). The width of the center section is 1.313 inches (3.34 cm) and the height or thickness of the center section is 0.470 inches (1.19 cm). The thickness of the flanges and of the compressible material on the center section is 0.0625 inches (0.159 cm). The height of each flange wall is 0.125 inches (0.318 cm). The length of the fastener member is 1.890 inches (4.80 cm). The length of the web interconnecting the posts is 1.320 inches (3.35 cm) and the width is 0.470 inches (1.19 cm). The thickness is 0.080 inches (2.03 cm). The height of the posts is 0.520 inches (1.32 cm) and the thickness is 0.331 inches (0.84 cm). These dimensions are purely illustrative and are not to be deemed limitations on the invention.

It is preferred that the connector strips be used to form the perimeter of the wall opening on all four sides. The first row of blocks is then mounted to the strips which form the floor as base of the opening. Alternatively, the size of the opening could be selected so that the outer edge surfaces of blocks form the perimeter for the opening. However, the use of connector strips to form the perimeter of the opening will result in a more sturdy framework.

As previously noted, vertical connector strips are positioned between the adjacent blocks in a row. After the first row of blocks is in place, horizontal connector strips are placed on top of the row. Fastener members are employed to couple the vertical strips sandwiched between a row of blocks to the horizontal strips positioned above and below said row. The procedure then is repeated for assembling successive rows of blocks.

The uppermost row of blocks is positioned in place by using a flat edge tool to displace the blocks slightly downwardly from the row of connector strips which defines the upper framework for the opening. There is still sufficient play, at this point in the wall assembly, to position the top row of blocks in place.

With the wall thus assembled, the blocks will have an outer peripheral edge laterally spaced from the longitudinally extending edges of the associated connector strips mounted thereon. The spacing between the outer edges, respectively, of adjacently located blocks and the adjacent longitudinally extending walls of the associated strips defines a plurality of channels which encompass the compartments formed, in part, by the laterally projecting ribs of the connector strips. A binder composition, such as mortar 80, is applied within the channels to anchor the blocks and associated connector strips in place wherein the compartments define multiple surfaces for receiving the binder composition.

There is thus provided a novel connector strip which, in combination with an interlocking fastener member, provides a framework for firmly and securely assembling a glass block building wall in which the blocks and the associated connector strips are anchored in place with a binder composition.

While a preferred embodiment of the invention has been shown and described in detail, it will be readily understood and appreciated that numerous omissions, changes and additions may be made without departing from the spirit and scope of the invention.

What is claimed is:

1. In a building block wall assembly comprising of plurality of molded building blocks each having a centrally located ridge extending peripherally around the outer edge surfaces thereof, and a plurality of longitudinal connector strips each having longitudinally extending grooves on oppositely disposed surfaces thereof, said grooves being sized to receive therein ridge portions of adjacently positioned blocks to assemble a wall of such blocks, wherein the improvement comprises:

said connector strips being substantially rigid and each having a longitudinally extending center section having a first outer surface and a second oppositely disposed outer surface spaced apart from said first surface by a predetermined thickness, said center section having first and second longitudinally extending edges;

said grooves being centrally located on said surfaces, respectively, of said center section, and said grooves extending longitudinally the length of said strip;

first and second longitudinally extending flanges projecting laterally outwardly from said first and second longitudinal edges, respectively, of said center section, said flanges being centrally located along the thickness of said center section and extending for the length of said strip, and said flanges having a thickness less than the thickness of said center section and terminating in first and second longitudinally extending edges, respectively, of said strip;

the width of said strip being less than the width of the building block to which said strip is to be mounted to locate the longitudinal edges of said flanges in contact with marginal edge surfaces of the building block; and wherein each of said flanges has a pair of oppositely disposed and longitudinally extending walls projecting outwardly from opposite surfaces thereof; and wherein each of said flanges further has a plurality of oppositely disposed and laterally extending ribs projecting outwardly from said walls, said flanges having a configuration to permit at least some of said ribs to engage the marginal edge surfaces of the building block to which said strip is to be mounted, whereby said longitudinal flanges, said longitudinal walls, and said lateral ribs define a plurality of open compartments on opposite sides of said flanges extending along said longitudinal edges of said strip; and further comprising resiliently compressible material mounted to said first and second surfaces of said center section on either side of said longitudinally extending grooves, said center section having a configuration to permit said compressible material to engage the outer edge surface of the building block to which said strip is to be mounted on either side of the building block ridge, said material having a outer surface coated with a pressure sensitive adhesive, and a removable release sheet mounted to said adhesive surface and adapted to be removed therefrom when said strip is mounted to the building block; and further comprising a fastener for coupling together adjacent segments of said connector strips, said fastener comprising first and second post elements Spaced apart from one another by an interconnecting web, said posts being sized to be received in the spaces, respectively, between said longitudinal edges of said center section of said connector strips and said center section of said connector strips and said longitudinal walls on said flanges of said strips, said web serving to space said posts apart from one another by a distance substantially equal to the lateral distance between said longitudinal edges of said center section of said strip; and wherein said blocks have an outer peripheral edge laterally spaced from the longitudinally extending edges of the associated connector strips mounted thereon, the spacing between the outer edges, respectively, of adjacently located blocks and the adjacent longitudinally extending walls of the associated connector strips defining a plurality of channels which include said open compartments, and a binder composition received in said channels to anchor said blocks and said associated connector strips in place.

2. A rigid longitudinal connector strip comprising:

a longitudinally extending center section having a first outer surface and a second appositely disposed outer surface Spaced apart from said first surface by a predetermined thickness, said center section having first and second longitudinally extending edges;

each of said first and second surfaces of said center having a longitudinally extending groove centrally located on said respective surfaces, said grooves having dimensions to receive therein a portion of a centrally located ridge extending peripherally around the outer edge surfaces of a molded building block to which said strip is to be mounted;

first and second longitudinally extending flanges projecting laterally outwardly from said first and second longitudinal edges, respectively, of said center section, said flanges having a thickness less than the thickness of said center section and terminating in first and second longitudinally extending edges, respectively, of said strip;

each of said flanges having a pair of oppositely disposed and longitudinally extending walls projecting outwardly from opposite surfaces thereof;

whereby said longitudinal flanges and said longitudinal walls define an open compartment on either side of said flanges extending along said longitudinal edges of said strip; and wherein said flanges are centrally located along with the thickness of said center section and extend longitudinally the length of said strip; and wherein each pair of said oppositely disposed and longitudinally extending walls are aligned in the same plane; and wherein said oppositely disposed and longitudinally extending walls extend for the length of said strip; and wherein each of said flanges further has a plurality of oppositely disposed and laterally extending ribs projecting outwardly from said walls on opposite sides of said flanges, said flanges having a configuration to permit at least some of said ribs to engage the marginal edge surfaces of the building block to which said strip is to be mounted, and wherein said longitudinal flanges, said longitudinal walls and said lateral ribs define a plurality of open compartments on either side of said flanges extending along said longitudinal edges of said strip; and wherein said plurality of laterally extending ribs are spaced apart from one another over the length of said strip; and wherein said oppositely disposed and laterally extending ribs are arranged in pairs aligned in the same plane; and wherein said laterally extending ribs project outwardly of said respective walls to said longitudinal edges of said strip; and wherein said connector strip further comprising resiliently compressible material mounted to said first and second surfaces of said center section, said center section having a configuration to permit said compressible material to engage the outer edge surface of the building block to which said strip is to be mounted.

3. The connector strip of claim 2 wherein said compressible material has an outer surface coated with a pressure sensitive adhesive, said strip further comprising a removable release sheet mounted to said adhesive surface of said compressible material and adopted to be removed therefrom when said strip is to be mounted to the building block.

4. The connector strip of claim 2, wherein said compressible material is mounted to said surfaces. The connector strip of claim 16, wherein said compressible material is mounted to said surfaces of said center section on either side of said longitudinally extending grooves, said compressible material adapted to engage the outer edge surfaces of the building block to which said strip is to be mounted on either side of the building block ridge.

5. A rigid longitudinal connector strip comprising:

a longitudinally extending center section having a first outer surface and a second oppositely disposed outer surface spaced apart from said first surface by a predetermined thickness, said center section having first and second longitudinally extending edges;

each of said first and second surfaces of said center section having a longitudinally extending groove centrally located on said respective surfaces, said grooves having dimensions to receive therein a portion of a centrally located ridge extending peripherally around the outer edge surfaces of a molded building block to which said strip is to be mounted;

first and second longitudinally extending flanges projecting laterally outwardly from said first and second longitudinal edges, respectively, of said center section, said flanges being centrally located along the thickness of said center section and extending for the length of said strip, and said flanges having a thickness less than the thickness of said center section and terminating in first and second longitudinally extending edges, respectively, of said strip;

each of said flanges having a pair of oppositely disposed and longitudinally extending walls projecting outwardly from opposite surfaces thereof, said walls being centrally located along the width of said flanges;

each pair of said walls being aligned in the same plane and extending for the length of said connector strip;

each of said flanges having a plurality of oppositely disposed and laterally extending ribs projecting outwardly from said walls on opposite sides of said flanges, said flanges having a configuration to permit at least some of said ribs to engage marginal edge surfaces of the building block to which said strip is to be mounted;

said oppositely disposed and laterally extending ribs being arranged in pairs aligned in the same plane, said ribs projecting outwardly of said respective walls to said longitudinal edges of said strip;

resiliently compressible material mounted to said first and second surfaces of said center section on either side of said longitudinally extending grooves, said center section having a configuration to permit said compressible material to engage the outer edge surface of the building block to which said strip is to be mounted on either side of the building block ridge, said compressible material having an outer surface coated with a pressure sensitive adhesive; and a removable release sheet mounted to said adhesive surface and adapted to be removed therefrom when said strip is to be mounted to the building block;

whereby said longitudinal flanges, said longitudinal walls and said lateral ribs define a plurality of open compartments on opposite sides of said flanges extending along said longitudinal edges of said strip.

6. A fastener for coupling together adjacent segments of connector strips wherein each of the strips has a center section having first and second longitudinally extending edges, and first and second longitudinally extending flanges projecting laterally outwardly from the first and second longitudinal edges, respectively, of the center section, and wherein each of the flanges has a pair of oppositely disposed and longitudinally extending walls projecting outwardly from opposite surfaces thereof, said fastener comprising:

first and second post elements spaced apart from one another by an interconnecting web;

said web serving to space said posts apart from one another wherein each of said posts has a pair of oppositely disposed and aligned slit openings sized to engage with the flanges of the connector strips for coupling together the lateral edges of adjacent segments of the strips, wherein the engagement of said slit post openings with the fingers of the connector strips is a frictional fit; and wherein the center section of each of the connector strips has a pair of oppositely disposed and longitudinally extending grooves located on opposite surfaces, respectively, of the center section, and wherein said interconnecting web has a pair of oppositely disposed and aligned cut-out notches, said notches located to be in alignment with the longitudinal grooves, respectively, of the center section of the connector strips when the strips are coupled together; and wherein each of said posts defines first and second oppositely disposed stem portions projecting from opposite surfaces, respectively, of said interconnecting web and projecting substantially perpendicular to the plane of said web, the first stem portion of said posts having a slit opening sized to engage with the lateral edges of the flanges, respectively, of one of the connector strips, the second stem portion of said posts being sized to be received in the spaces, respectively, between the longitudinal edges of the center section of the other one of the adjacent connector strips and the longitudinal walls on the flanges of the other connector strip for coupling together the connector strips in a substantially perpendicular configuration.

7. A method of assembling a building block wall assembly made of a plurality of molded building blocks each having a centrally located ridge extending peripherally around the outer edge surfaces thereof;

Comprising the steps of:

a. mounting a rigid first longitudinal connector strip to the outer edge surface of said plurality of molded building blocks adjacently positioned in a row in edge to edge alignment, said strip having a longitudinally extending center section having a first outer surface and a second oppositely disposed outer surface spaced apart from said first surface by a predetermined distance, said center section having first and second longitudinally extending edges, said first and second surfaces of said center section each having a longitudinally extending groove centrally located on said respective surfaces, said grooves being sized to receive therein ridge portions of adjacently positioned blocks, said strip having first and second longitudinally extending flanges projecting laterally outwardly from said first and second longitudinal edges, respectively, of said center section, said flanges being centrally located along the thickness of said center section and extending for the length of said strip, said flanges having a thickness less than the thickness of said center section and terminating in first and second longitudinally extending edges, respectively, of said strip, the width of said strip being less than the width of the aligned building blocks to which said strip is mounted to locate the longitudinal edges of said flanges in contact with marginal edge surfaces of the blocks, each of said flanges having a plurality of oppositely disposed and longitudinally extending walls projecting outwardly from opposite surfaces thereof;

b. mounting a second connector strip to the facing edge surfaces, respectively, of the adjacently positioned blocks so as to be sandwiched there between, said second strip constructed similar to said first strip and being shorter than said first strip, said second strip having a length less than the length of the blocks to which said second strip is mounted, said strip and said second strip being in substantially perpendicular relation to one another when said strips are in their respective mounted positions;

c. coupling together adjacent segments of said first and second connector strips by a first fastener member, said fastener having first and second post elements spaced apart from one another by an interconnecting web, said web serving to space said posts apart from one another by a distance substantially equal to the lateral distance between the longitudinal edges of the center section of said strips, each of said posts defining first and second oppositely disposed stem portions projecting from opposite surfaces, respectively, of said interconnecting web and projecting substantially perpendicular to the plane of said web, each of said stem portions having a slit opening with the slit opening of said second stem portion being oppositely disposed and aligned to the slit opening of said first stem portion, the slit openings in the respective first stem portions of said posts being sized to engage with the lateral edges of the flanges, respectively, of said second connector strip, the second stem portions of said posts being sized to be received in the spaces, respectively between the longitudinal edges of the center section of said first connector strip and the longitudinal walls on the flanges of said first strip for coupling, together with said first and second strips in a substantially perpendicular configuration;

d. mounting a third longitudinal connector strip similar to said first connector strip to the opposite outer surfaces of said row of blocks;

e. coupling together adjacent segments of said second and third connector strips by a second fastener member similar to said first fastener member;

f. repeating steps a, b, and c for assembling successive rows of blocks wherein said third connector strip is mounted to the outer edge surfaces of said plurality of model building blocks adjacently positioned in a second row in edge to edge alignment so as to be sandwiched between first and second rows of blocks, said blocks having an outer peripheral edge laterally spaced from the longitudinally extending edges of the associated connector strips mounted thereon, the spacing between the outer edges, respectively, of adjacently located blocks and the adjacent longitudinally extending walls of said associated strips defining a plurality of channels; and g. applying a binder composition within said channels to anchor said blocks and said associated connector strips in place.

8. The method of assembling said building block wall assembly of claim 7, wherein the flanges of said first, second and third connector strips each have a plurality of oppositely disposed and laterally extending ribs projecting outwardly from said walls on opposite sides of said flanges, said oppositely disposed and laterally extending ribs being arranged in pairs aligned in the same plane, said ribs projecting outwardly of said respective walls to the longitudinal edges of said strips, said flanges having a configuration to permit at least some of said ribs to engage marginal edge surfaces of the said plurality of molded building blocks to which said strips are mounted, said flanges and said walls and said ribs defining a plurality of open compartments on opposite sides of said flanges extending along the edges of said strips, and said compartments being with the channels defined by the outer edges of adjacently located said plurality of molded building blocks and the adjacent longitudinally extending walls of the associated connector strips.

9. The method of assembling said building block wall assembly of claim 8, wherein said first, second and third connector strips each have a resiliently compressible material mounted to the first and second surfaces of said center section on either side of said longitudinally extending grooves, said center section having a configuration to permit said compressible material to engage the outer edge surface of associated said plurality of molded building blocks to which each said strip is mounted on either side of the said plurality of molded building blocks ridge, said material having an outer surface coated with a pressure sensitive adhesive, and a removable release sheet mounted to said adhesive surface, said method further comprising the step of removing said release sheet from the adhesive surface of the connector strip when said strip is mounted to the associated said plurality of molded building blocks.

* * * * *